US006270531B1

(12) United States Patent
DeYoung et al.

(10) Patent No.: US 6,270,531 B1
(45) Date of Patent: Aug. 7, 2001

(54) END FUNCTIONALIZED POLYSILOXANE SURFACTANTS IN CARBON DIOXIDE FORMULATIONS

(75) Inventors: James P. DeYoung; Gina M. Stewart; Bernadette Storey-Laubach, all of Durham, NC (US)

(73) Assignee: Micell Technologies, Inc., Raleigh, NC (US)

( * ) Notice: Subject to any disclaimer, the term of this patent is extended or adjusted under 35 U.S.C. 154(b) by 0 days.

(21) Appl. No.: 09/143,296

(22) Filed: Aug. 28, 1998

Related U.S. Application Data

(60) Provisional application No. 60/057,063, filed on Aug. 29, 1997, now abandoned, and provisional application No. 60/086,969, filed on May 28, 1998, now abandoned.

(51) Int. Cl.[7] ..... D06L 1/12
(52) U.S. Cl. ..... 8/142
(58) Field of Search ..... 8/142; 510/291, 510/466

(56) References Cited

U.S. PATENT DOCUMENTS

| | | | |
|---|---|---|---|
| 3,389,160 | 6/1968 | Reid et al. | 260/448.2 |
| 4,472,566 | 9/1984 | Ziemelis et al. | 528/38 |
| 4,507,455 | 3/1985 | Tangney et al. | 528/26 |
| 4,609,750 | 9/1986 | Kollmeier et al. | 556/419 |
| 4,911,853 | 3/1990 | Coffindaffer et al. | 252/8.8 |
| 5,026,489 | 6/1991 | Snow et al. | 252/8.8 |
| 5,087,715 | 2/1992 | Snow | 556/413 |
| 5,676,705 | * 10/1997 | Jureller et al. | 8/142 |
| 5,683,473 | 11/1997 | Jureller et al. | 8/142 |
| 5,683,977 | 11/1997 | Jureller et al. | 510/286 |
| 5,780,553 | 7/1998 | DeSimone et al. | 525/276 |
| 5,789,505 | 8/1998 | Wilkinson et al. | 526/209 |
| 5,858,022 | 1/1999 | Romack et al. | 8/142 |
| 5,866,005 | 2/1999 | DeSimone et al. | 210/634 |
| 5,977,045 | 11/1999 | Murphy | 510/289 |

FOREIGN PATENT DOCUMENTS

| | | |
|---|---|---|
| 96/27704 | 9/1996 | (WO) . |
| 97/16264 | 5/1997 | (WO) . |

OTHER PUBLICATIONS

Hoefling et al.; *Design and Synthesis of Highly $CO_2$–Soluble Surfactants and Chelating Agents*, Fluid Phase Equilibria, 83:203–212 (1993), No Month Available.

Matisons et al.; *Characterization of Novel Cationic Aminohydroxysiloxanes, Macromolecules,* 27:3397–3405 (1994), No Month Available.

Hoefling et al.; *Microemulsions in Near–Critical and Supercritical $CO_2$ , J. Phys. Chem.,* 95:7127–7129 (1991), No Month Available.

Hoefling et al.; *The Incorporation of a Fluorinated Ether Functionality into a Polymer or Surfactant to Enhance $CO_2$–Solubility, The J. of Supercritical Fluids,* 5:237–241 (1992), No Month Available.

Yazdi et al.; *Design, Synthesis, and Evaluation of Novel, Highly $CO_2$–Soluble Chelating Agents for Removal of Metals, Ind. Eng. Chem. Res.,* 35:3644–3652 (1996), No Month Available.

Newman et al.; *Phase Behavior of Fluoroether–Functional Amphilphiles in Cupercritical Carbon Dioxide, The J. of Supercritical Fluids,* 6:205–210 (1993), No Month Available.

Hoefling et al.; *Effect of Structure on the Cloud–Point Curves of Silicone–Based Amphiphiles in Cupercritical Carbon Dioxide, The J. of Supercritical Fluids,* 6:165–171 (1993), No Month Available.

Xiong et al.; *Miscibility, Density and Viscosity of Poly(Dimethylsiloxane) in Supercritical Carbon Dioxide, Polymer,* 36(25):4817–4826 (1995), No Month Available.

Stofesky et al.; *The Effect of Hydroxyaluminum Disoaps and Perfluoroalkylpolyethers on the Viscosity of Liquid Propane and Carbon Dioxide*, Proceedings 6$^{th}$ Int'l Symposium on SCFs, McHugh, M.A., Ed. Johns Hopkins University: Baltimore, MD, pp. 341–344 (1991), No Month Available.

Saito; *Research Activities on Supercritical Fluid Science and Technology in Japan—A Review, The J. of Supercritical Fluids,* 8:177–204 (1995), No Month Available.

Yazdi et al.; *Design of Highly $CO_2$–Soluble Chelating Agents for Carbon Dioxide Extraction of Heavy Metals, J. Mater. Res.,* 10(3):530–537 (Mar. 1995).

International Search Report, PCT/US98/17926, Dec. 22, 1998.

* cited by examiner

*Primary Examiner*—Caroline D. Liott
(74) *Attorney, Agent, or Firm*—Myers Bigel Sibley & Sajovec, P.A.

(57) ABSTRACT

A method for dry-cleaning articles such as fabrics and clothing in carbon dioxide comprises contacting an article to be cleaned with a liquid dry cleaning composition for a time sufficient to clean the fabric. The liquid dry-cleaning composition comprises a mixture of carbon dioxide, water, and an end-functional polysiloxane surfactant. After the contacting step, the article is separated from the liquid dry cleaning composition. The method is preferably carried out at ambient temperature.

7 Claims, No Drawings

END FUNCTIONALIZED POLYSILOXANE SURFACTANTS IN CARBON DIOXIDE FORMULATIONS

This application claims priority from Provisional Application Ser. No. 60/057,063, filed Aug. 29, 1997, and from Provisional Application Ser. No. 60/086,969, filed May 28, 1998, the disclosures of which are incorporated by reference herein in their entirety.

FIELD OF THE INVENTION

The present invention relates to carbon dioxide-based formulations that contain surfactants, and methods of using the same. The compositions and methods are useful for a variety of applications, including the cleaning of garments and fabrics.

BACKGROUND OF THE INVENTION

Commercial dry cleaning systems currently employ potentially toxic and environmentally harmful halocarbon solvents, such as perchloroethylene. Carbon dioxide has been proposed as an alternative to such systems in U.S. Pat. No. 4,012,194 to Maffei. A problem with carbon dioxide is, however, its lower solvent power relative to ordinary solvents.

PCT Application WO 97/16264 by The University of North Carolina at Chapel Hill describes cleaning systems that employ liquid or supercritical carbon dioxide in combination with a surfactant that contains a "$CO_2$-philic" group. The term "$CO_2$-philic" was first coined in conjunction with such surfactants by J. DeSimone and colleagues. See, e.g., J. DeSimone et al., *Science* 265, 356–359 Jul. 15, 1994).

PCT Application WO96/27704 (Sep. 12, 1996) by Unilever, describes dry cleaning systems using densified carbon dioxide and special surfactant adjuncts. The surfactants employed have a $CO_2$-philic moiety connected to a $CO_2$-phobic moiety. See also U.S. Pat. No. 5,683,473 to Jureller et al; U.S. Pat. No. 5,683,977 to Jureller et al.; U.S. Pat. No. 5,676,705 to Jureller et al.

U.S. Pat. No. 5,377,705 to Smith et al. describes a precision cleaning system in which a work piece is cleaned with a mixture of $CO_2$ and a co-solvent. Smith provides an entirely non-aqueous system, stating: "The system is also designed to replace aqueous or semi-aqueous based cleaning processes to eliminate the problems of moisture damage to parts and water disposal" (col. 4 line 68 to col. 5 line 3). Co-solvents that are listed include acetone and ISOPAR™ M (col. 8, lines 19–24). Use in dry cleaning is neither suggested nor disclosed. Indeed, since some water must be present in dry-cleaning, such use is contrary to this system.

In view of the foregoing, there is a continuing need for effective carbon dioxide-based cleaning systems.

SUMMARY OF THE INVENTION

A method for cleaning articles such as fabrics and clothing in carbon dioxide comprises contacting an article to be cleaned with a liquid dry cleaning composition for a time sufficient to clean the fabric. The liquid dry-cleaning composition comprises a mixture of carbon dioxide, optionally water, and an end-functional polysiloxane surfactant. In one embodiment an organic co-solvent is also included. After the contacting step, the article is separated from the liquid dry cleaning composition. Preferably, the liquid dry cleaning composition is at ambient temperature, of about 0° C. to 30° C.

End-functional polylsiloxanes used in carrying out the present invention are represented by the formula $X_1$—A—$X_2$, wherein $X_1$ and $X_2$ are the end-functional groups or moities (e.g. as described below) and A is a siloxane group such as polydimethylsiloxane.

As discussed below, the end-functional polysiloxane may be provided in liquid $CO_2$ as a mixture, the mixture useful as an intermediate for preparing the dry cleaning compositions noted above, or useful in other applications where a surfactant in carbon dioxide is desired (including, but not limited to, electronic cleaning operations such as silicon wafer cleaning, cleaning mechanical parts sucy as gyroscopes, dry cleaning of fabrics, as wetting agents for $CO_2$ based systems, and as dispersing additives for compounds including organic and inorganic compounds dispersed in $CO_2$, as described in U.S. Pat. No. 5,789,505).

Also disclosed is an improved a process which involves contacting liquid or supercritical $CO_2$ with a mobile $CO_2$-phobic substance. The improvement comprises lowering the surface tension between said $CO_2$ and $CO_2$-phobic substance by adding to the $CO_2$ an end-functional polysiloxane surfactant.

A further aspect of the present invention is a composition comprising: (a) liquid or supercritical carbon dioxide; and (b) from 0.001 to 30 percent surfactant, wherein said surfactant is an end-functional polysiloxane surfactant having the formula $X_1$—A—$X_2$, wherein $X_1$ and $X_2$ are $CO_2$-phobic groups, and A is a polysiloxane group.

A further aspect of the invention is a composition comprising: (a) liquid or supercritical carbon dioxide; (b) from 0.001 to 30 percent surfactant, wherein said surfactant is an end-functional polysiloxane surfactant; and (c) from 0.01 to 50 percent of a $CO_2$-phobic compound, which $CO_2$-phobic compound is non-covalently associated with said surfactant.

DETAILED DESCRIPTION OF THE INVENTION

The terms alkyl or loweralkyl as used herein means C1 to C4 linear or branched, saturated or unsaturated alkyl, including methyl, ethyl, propyl, isopropyl, butyl, sec-butyl, and tert-butyl.

The term "halo" as used herein means halogen, including fluoro, chloro, bromo, and iodo. Fluoro is preferred.

The term "clean" as used herein refers to any removal of soil, dirt, grime, or other unwanted material, whether partial or complete. The invention may be used to clean nonpolar stains (i.e., those which are at least partially made by nonpolar organic compounds such as oily soils, sebum and the like), polar stains (i.e., hydrophilic stains such as grape juice, coffee and tea stains), compound hydrophobic stains (i.e., stains from materials such as lipstick and candle wax), and particulate soils (i.e., soils containing insoluble solid components such as silicates, carbon black, etc.).

Articles that can be cleaned by the method of the present invention are, in general, garments and fabrics (including woven and non-woven) formed from materials such as cotton, wool, silk, leather, rayon, polyester, acetate, fiberglass, furs, etc., formed into items such as clothing, work gloves, rags, leather goods (e.g., handbags and brief cases), etc.

"End Functional" Polysiloxane (PSI) materials have specific utility as surfactants in the formulation of $CO_2$ based cleaning systems. Detergency in non-aqueous cleaning systems is facilitated by surfactants that increase the quantity and stability of entrained water in the system. End Functional PSI materials are differentiated from other functional PSI materials by the locale and orientation of the functional group (e.g., hydrophilic or lipophilic functional groups; preferably hydrophilic functional groups) being at either (or both) termini of the molecules. The term "termini" or "terminus" herein refers to the discontinuation or end of dimethyl siloxane repeat units in the molecule. Thus the functional group is typically covalently joined to a dimethyl silyl group, rather than emanating from a methyl siloxane linkage in the backbone of the polymer.

As noted above, end-functional polysiloxane surfactants used in carrying out the present invention are represented by the formula $X_1$—A—$X_2$, wherein $X_1$ and $X_2$ are the end-functional groups or moities (e.g. as described below) and A is polysiloxane group such as polydimethylsiloxane, typically having a molecular weight of 100 or 200 to 100,000, 200,000 or 400,000 g/mole. Such compounds are more particularly represented by the formula:

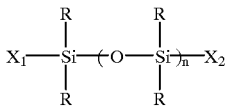

wherein:

n is from 1 or 2 to 20, 100, 500, 1,000, 5,000, or 10,000. Preferably, n is 1 or 2 to 20, 50 or 100.

At least one, and preferably both, of $X_1$ and $X_2$ are $CO_2$-phobic groups, such as lipophilic or hydrophilic (e.g., anionic, cationic) groups, but are not $CO_2$-philic groups. The $X_1$ and $X_2$ groups may be the same or different. Optionally, but less preferably, one of $X_1$ or $X_2$ may be a $CO_2$-philic group, such as an alkyl or aryl group as the polysiloxane end terminus.

R is alkyl, aryl, or haloalkyl such as perfluoroalkyl. Lower alkyl, particularly methyl, is preferred, trifluoropropyl is preferred, and phenyl is preferred. Methyl is most preferred.

In general, the materials of the invention contain multiple siloxane repeat units that are "$CO_2$-philic", and $CO_2$-phobic end-functional groups capable of forming non-covalent associations or positive interactions with desired compounds, such as water, hydrophilic soils, oils, hydrophobic soils, etc.

PSI reactive materials that can be used as precursors for end functional PSI surfactants are silicones with reactive groups that upon reaction with a given substrate yield end functional materials. Reactive groups include but are not limited to; Vinyl, hydride, silanol, alkoxy/polymeric alkoxide, amine, epoxy, carbinol, methacrylate/acrylate, mercapto, acetoxy/chlorine/dimethylamine moieties.

Additional examples of functional end groups include, but are not limited to, hydrophilic end groups such as ethylene glycol, polyethylene glycol, alcohols, alkanolamides, alkanolamines, alkylaryl sulfonates, alkylaryl sulfonic acids, alkylaryl phosphates, alkylphenol ethoxylates, betaines, quaternary amines, sulfates, carbonates, carbonic acids, secondary amines, tertiary amines, aliphatic amines, polyamines, acetylacetate, carbohydrates, anhydrides, malonic esters, alkyl phosphates, glycidyl ethers, and amino acids (including derivatives thereof), etc.; and lipophilic end groups such as linear, branched, and cyclic alkanes, mono and polycyclic aromatic compounds, alkyl substituted aromatic compounds, polypropylene glycol, polypropylene aliphatic and aromatic ethers, fatty acid esters, lanolin, lecithin, lignins (including lignin derivatives), alkyl sulfates, anhydrides, glycidyl ethers, aliphatic amines, and amino acids (including derivatives thereof), etc.

An example of an end functional PSI material useful in improving the quantity and stability of water in carbon dioxide and also useful in facilitating detergency is 3-([2-hydroxy-3-diethylamino]propoxy)propyl terminated polydimethylsiloxane. The material has a number average molecular weight of about 200 TO 50,000 g/mole, preferably about 1200 g/mole.

The surfactants of the invention can be employed with any carbon-dioxide dry cleaning system, such as described in U.S. Pat. No. 5,683,473 to Jureller et al; U.S. Pat. No. 5,683,977 to Jureller et al.; U.S. Pat. No. 5,676,705 to Jureller et al; and U.S. Pat. No. 4,012,194 to Maffei, the disclosures of which applicants specifically intend to be incorporated herein by reference. Where these prior systems include a surfactant, the surfactants of the invention may be substituted for, or used in combination with, the surfactants described therein.

In one particular embodiment, Liquid compositions useful for carrying out the present invention typically comprise:

(a) from zero or 0.1 to 10 percent (and when included, more preferably from 0.1 to 4 percent) water;

(b) carbon dioxide (to balance; typically at least 30 percent);

(c) surfactant (preferably from 0.001, 0.01, 0.1 or 0.5 percent to 5, 10 or 30 percent); and (d) from zero or 0.1 to 50 percent (and in one embodiment from 2 or 4 to 30 percent) of an organic co-solvent.

Where a $CO_2$-phobic substance is included in the composition, it is typically included in an amount of from 0.01, 0.1, or 0.5 to 10, 30, or 50 percent by weight.

Percentages herein are expressed as percentages by weight unless otherwise indicated.

The composition is provided in liquid form at ambient, or room, temperature, which will generally be between zero and 50° Centigrade. The composition is held at a pressure that maintains it in liquid form within the specified temperature range. The cleaning step is preferably carried out with the composition at ambient temperature.

The organic co-solvent is, in general, a hydrocarbon co-solvent, including but not limited to alkane, alkene, ether, ester and alcohol cosolvents. Typically the co-solvent is an alkane co-solvent, with $C_{10}$ to $C_{20}$ linear, branched, and cyclic alkanes, and mixtures thereof (preferably saturated) currently preferred. The organic co-solvent preferably has a flash point above 140° F., and more preferably has a flash point above 170° F. The organic co-solvent may be a mixture of compounds, such as mixtures of alkanes as given above, or mixtures of one or more alkanes in combination with additional compounds such as one or more alcohols (e.g., from 0 or 0.1 to 5% of a C1 to C15 alcohol (including diols, triols, etc.)).

As noted above, other surfactants can be employed in combination with the surfactants of the invention, including surfactants that contain a $CO_2$-philic group (such as described in U.S. Pat. No. 5,683,473 to Jureller et al; U.S. Pat. No. 5,683,977 to Jureller et al.; U.S. Pat. No. 5,676,705 to Jureller et al, the disclosures of which are incorporated herein by reference) linked to a $CO_2$-phobic group (e.g., a lipophilic group) and surfactants that do not contain a $CO_2$-philic group (i.e., surfactants that comprise a hydrophilic group linked to a hydrophobic (typically lipophilic) group). A single surfactant may be used, or a combination of surfactants may be used. Numerous surfactants are known to those skilled in the art. See, e.g., McCutcheon's Volume 1: Emulsifiers & Detergents (1995 North American Edition) (MC Publishing Co., 175 Rock Road, Glen Rock, N.J. 07452). Examples of the major surfactant types that can be used to carry out the present invention include the: alcohols, alkanolamides, alkanolamines, alkylaryl sulfonates, alkylaryl sulfonic acids, alkylbenzenes, amine acetates, amine oxides, amines, sulfonated amines and amides, betaine derivatives, block polymers, carboxylated alcohol or alkylphenol ethoxylates, carboxylic acids and fatty acids, diphenyl sulfonate derivatives, ethoxylated alcohols, ethoxylated alkylphenols, ethoxylated amines and/or amides, ethoxylated fatty acids, ethoxylated fatty esters and oils, fatty esters, fluorocarbon-based surfactants, glycerol esters, glycol esters, hetocyclic-type products, imidazolines and imidazoline derivatives, isethionates, lanolin-based derivatives, lecithin and lecithin derivatives, lignin and lignin deriviatives, maleic or succinic anhydrides, methyl esters, monoglycerides and derivatives, olefin sulfonates, phosphate esters, phosphorous organic derivatives, polyethylene glycols, polymeric (polysaccharides, acrylic acid, and acrylamide) surfactants, propoxylated and ethoxylated fatty acids alcohols or alkyl phenols, protein-based surfactants, quaternary surfactants, sarcosine derivatives, silicone-based surfactants, soaps, sorbitan derivatives, sucrose and glucose esters and derivatives, sulfates and sulfonates of oils and fatty acids, sulfates and sulfonates ethoxylated alkylphenols, sulfates of alcohols, sulfates of ethoxylated alcohols, sulfates of fatty esters, sulfonates of benzene, cumene, toluene and xylene, sulfonates of condensed naphthalenes, sulfonates of dodecyl and tridecylbenzenes, sulfonates of naphthalene and alkyl naphthalene, sulfonates of petroleum, sulfosuccinamates, sulfosuccinates and derivatives, taurates, thio and mercapto derivatives, tridecyl and dodecyl benzene sulfonic acids, etc.

As will be apparent to those skilled in the art, numerous additional ingredients can be included in the dry-cleaning composition, including detergents, bleaches, whiteners, softeners, sizing, starches, enzymes, hydrogen peroxide or a source of hydrogen peroxide, fragrances, etc.

In practice, in a preferred embodiment of the invention, an article to be cleaned and a liquid dry cleaning composition as given above are combined in a closed drum. The liquid dry cleaning composition is preferably provided in an amount so that the closed drum contains both a liquid phase and a vapor phase (that is, so that the drum is not completely filled with the article and the liquid composition). The article is then agitated in the drum, preferably so that the article contacts both the liquid dry cleaning composition and the vapor phase, with the agitation carried out for a time sufficient to clean the fabric. The cleaned article is then removed from the drum. The article may optionally be rinsed (for example, by removing the composition from the drum, adding a rinse solution such as liquid $CO_2$ (with or without additional ingredients such as water, co-solvent, etc.) to the drum, agitating the article in the rinse solution, removing the rinse solution, and repeating as desired), after the agitating step and before it is removed from the drum. The dry cleaning compositions and the rinse solutions may be removed by any suitable means, including both draining and venting.

Any suitable cleaning apparatus may be employed, including both horizontal drum and vertical drum apparatus. When the drum is a horizontal drum, the agitating step is carried out by simply rotating the drum. When the drum is a vertical drum it typically has an agitator positioned therein, and the agitating step is carried out by moving (e.g., rotating or oscillating) the agitator within the drum. A vapor phase may be provided by imparting sufficient shear forces within the drum to produce cavitation in the liquid dry-cleaning composition. Finally, in an alternate embodiment of the invention, agitation may be imparted by means of jet agitation as described in U.S. Pat. No. 5,467,492 to Chao et al., the disclosure of which is incorporated herein by reference. As noted above, the liquid dry cleaning composition is preferably an ambient temperature composition, and the agitating step is preferably carried out at ambient temperature, without the need for associating a heating element with the cleaning apparatus.

In addition, the end-functional polysiloxane surfactants, and liquid or supereritical $CO_2$ compositions containing the same, can be used for purposes including, but not limited to, electronic cleaning operations such as silicon wafer cleaning, cleaning mechanical parts sucy as gyroscopes, dry cleaning of fabrics, as wetting agents for $CO_2$ based systems, and as dispersing additives for compounds including organic and inorganic compounds dispersed in $CO_2$, as described in U.S. Pat. No. 5,789,505, the disclosure of which is incorporated by reference herein in its entirety.

The present invention is explained in greater detail in the following non-limiting examples.

EXAMPLE 1

1.032 grams of 3([2-hydroxy-3-diethylamino]propoxy) propyl terminated polydimethylsiloxane with a number average molecular weight of ~1200 g/mole was added to a 10cc high pressure cell with 100 mg of $H_2O$. Liquid $CO_2$ was then added to the cell at ambient temperature to a pressure of 2000 psi and stirring was initiated. Over a period of ~2 min the mixture went from dual phase mostly opaque to homogeneous and very slightly hazy. After 10 min the mixture was still homogeneous. The same experiment without added end functional siloxane resulted in a mixture that remained dual phase upon continued stirring.

EXAMPLE 2

3-([2-hydroxy-3-diethylamino]propoxy)propyl terminated polydimethylsiloxane as described above is synthesized as follows. Starting with epoxypropoxypropyl terminated polydimethylsiloxane with an average molecular weight range of 900–1100 g/mole, the siloxane and a 5 molar excess of diethyl amine are added to a round bottom flask equipped with a reflux condenser. A heating bath is applied to the round bottom flask with a bath temperature of about 78° C. and the mixture is refluxed under a static argon head pressure for about 48 hours. The product is isolated by distilling the excess diethyl amine from the polymer and exposing the polymer to a vacuum <1 mm Hg for 12 hours.

The foregoing is illustrative of the present invention, and is not to be construed as limiting thereof. The invention is defined by the following claims, with equivalents of the claims to be included therein.

That which is claimed is:

1. A method for cleaning garments or fabrics in carbon dioxide, comprising:

contacting a garment or fabric article to be cleaned with a liquid dry cleaning composition for a time sufficient to clean the article, said liquid dry-cleaning composition comprising a mixture of carbon dioxide, water, and a surfactant, wherein said surfactant is 3-([2-hydroxy-3-diethylamino]propoxy)propyl terminated polydimethylsiloxane; and then separating the article from the liquid dry cleaning composition.

2. The method according to claim 1, wherein said liquid dry cleaning composition is at a temperature of 0° C. to 30° C.

3. The method according to claim 1, said composition further comprising an organic co-solvent.

4. A method for cleaning garments or fabrics in carbon dioxide, comprising:

contacting a garment or fabric article to be cleaned with a liquid dry cleaning composition for a time sufficient to clean the article, said liquid dry-cleaning composition comprising a mixture of carbon dioxide, water, and a surfactant having the following formula:

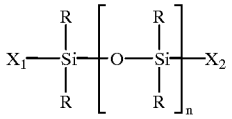

wherein R is selected from the group consisting of trifluoropropyl and phenyl, $X_1$ and $X_2$ are end-functional $CO_2$-phobic groups, and n is from 1 to 10,000; and then separating the article from the liquid dry cleaning composition.

5. A method according to claim 4, wherein $X_1$ and $X_2$ are the same.

6. A method according to claim 4, wherein said liquid dry cleaning composition is at a temperature of 0° C. to 30° C.

7. A method according to claim 4, said composition further comprising an organic co-solvent.

* * * * *